United States Patent [19]

Peters

[11] Patent Number: 4,953,838

[45] Date of Patent: Sep. 4, 1990

[54] WORK POSITIONING DEVICE

[76] Inventor: Michael X. Peters, 13967 Marquesas Way, No. 46, Marina Del Ray, Calif. 90292

[21] Appl. No.: 402,235

[22] Filed: Sep. 5, 1989

[51] Int. Cl.[5] ..... B25B 1/22

[52] U.S. Cl. ..... 269/45

[58] Field of Search ..... 269/95, 907, 82–85, 269/71, 75; 403/96, 97, 55, 389, 390, 391, 385; 248/122, 124, 274, 276, 278, 288.5, 160, 480, 291

[56] References Cited

U.S. PATENT DOCUMENTS

| | | | |
|---|---|---|---|
| 3,024,018 | 3/1962 | Manz | 269/84 |
| 4,253,649 | 3/1981 | Hewson | 269/45 |
| 4,500,077 | 2/1985 | Coxon | 269/45 |

*Primary Examiner*—Robert C. Watson

*Attorney, Agent, or Firm*—Robert J. Schaap

[57] ABSTRACT

A work positioning device for positioning a work piece relative to a tool in an essentially unlimited number of positions. The work positioning device comprises a frame with a mounting arm pivotally connected to one end of the frame and which enables the frame to be rotatable about a first axis. The mounting arm is adapted for securement to a fixed structure. The work positioning device also comprises a second positioning arm which is rotatably with respect to the first positioning arm and a work holding arm rotatable with respect to the second positioning arm. A clamping mechanism is provided on the work holding arm to releasable secure a work piece thereto. This structure enables the frame and the positioning arms to be movable relative to one another in order to move a work piece to an essentially unlimited number of positions.

15 Claims, 3 Drawing Sheets

WORK POSITIONING DEVICE

BACKGROUND OF THE INVENTION

1. Field of the Invention.

This invention relates in general to certain new and useful improvements in positioning devices for positioning work pieces relative to a tool and more particularly, to a work piece positioning device in which there are a large number of moveable arms to provide the positioning of a work piece in an essentially unlimited number of positions with respect to a tool.

2. Brief Description of the Prior Art.

There are a large number of work holding and work positioning devices which are used to position a work piece with respect to another member, such as a tool. Usually, the work positioning and work holding devices adopt the form of a vise. As a simple example, it is oftentimes necessary to position a work piece such as metal rod with respect to a source of solder so that a user may solder onto the work piece. In like manner, two pieces of wire may be soldered together by positioning and holding each of the two pieces of wire relative to a source of solder so that the soldering electrode may be brought in contact therewith.

Many of these positioning and work holding devices, which are in the nature of vises, are rather elaborate. For example, some of these vises include a base for securement to a stationary structure and which allows a swivel mechanism to be rotated in a horizontal plane. In like manner, a vise head including a pair of jaws is mounted on this swivel mechanism for movement in a circular plane relative to the swivel mechanism and also movement in a vertically or generally vertically disposed arcuate plane.

One well known conventional work positioning device is offered by Pana Vice, Inc. of Long Beach, Calif. This work positioning device comprises a base having a swivel mechanism and a vise head having a pair of jaws. Other types of work holding products are also available and utilize similar constructions.

Each of these prior art work holding devices and work positioning devices are inherently ineffective for their intended purposes. Generally, they require a plurality of adjustments such that the user must first position the vise head in one axis and then tighten an adjustment knob, position the work head for movement in another axis and tighten an adjustment knob etc. Thus, these conventional work positioning devices are time consuming to use and oftentimes difficult to precisely position a work piece with respect to a tool.

In addition to the above, these prior art devices are expensive in that they require a large number of mounting accessories such as different bases, different heads, and like components in order to obtain the full versatility of such products. Nevertheless, in essentially all embodiments, the work piece is not universally positionable through an essentially unlimited number of positions with respect to a tool.

OBJECTS OF THE INVENTION

It is, therefore, one of the primary objects of the present invention to provide a work positioning device which can position a work piece with respect to another member, such as a tool, in an essentially unlimited number of positions.

It is another object of the present invention to provide a work positioning device of the type stated which is highly effective in that it utilizes a plurality of arms moveable with respect to one another in order to precisely and properly position a work piece with respect to another member.

It is a further object of the present invention to provide a work positioning device of the type stated which is relatively simple to use and does not require numerous time consuming adjustments in order to position a work piece with respect to a tool.

It is still another object of the present invention to provide a work positioning device of the type stated which can be constructed at a relatively low cost and which is relatively simple in operation and use.

With the above and other objects in view, my invention resides in the novel features of form, construction, arrangement and combination of parts presently described and pointed out in the claims.

SUMMARY OF THE INVENTION

The invention relates to a work positioning device for positioning a work piece relative to a tool in an essentially unlimited number of positions. The positioning device is highly effective in positioning a work piece with respect to a tool, although it is effective in positioning a work piece with respect to essentially any other member in which there may be an essentially unlimited number of positions required for the work piece with respect to the other member.

The work positioning device of the invention comprises a main frame. A mounting arm is pivotally connected to one end of the frame and enables the frame to be rotatable about a first axis. The mounting arm is also adapted for securement to a fixed structure.

A first positioning arm is pivotally connected to another end of the frame, that is an end opposite to which the mounting arm is pivotally secured. The first positioning arm is rotatable about a second axis with respect to the frame. In a more preferred embodiment, the second axis is generally parallel in space to the first axis, although it is not coincident with the first axis.

A second positioning arm is pivotally connected to the first positioning arm and is rotatable about a third axis. A work holding arm is pivotally connected to the second positioning arm and is rotatable with respect thereto about a fourth axis. The work holding arm is capable of being moved to an essentially unlimited number of positions by movement through these four axes with respect to a tool or other member.

Finally, means is associated with the work holding arm to releasably secure a work piece with respect thereto. This means to releasably secure the work piece may adopt the form of a manually operable clamping mechanism.

In a more preferred embodiment, the second axis is generally parallel in space to the first axis, as aforesaid, so that the first positioning arm in moved in a plane generally parallel to the mounting arm. The third axis is generally perpendicular to the second axis.

In still a more preferred embodiment, the first positioning arm has an angularly struck portion, such as a perpendicularly struck portion. The second positioning arm also has an angularly struck portion, which is preferably a perpendicularly struck portion. The angularly struck portions of the first and second positioning arms are pivotally secured to one another. Further, the fourth axis of rotation is generally perpendicular in space to the third axis of rotation.

This invention possesses many other advantages and has other purposes which may be made more clearly apparent from a consideration of the forms in which it may be embodied. These forms are shown in the drawings forming a part of and accompanying the present specification. They will now be described in detail for the purposes of illustrating the general principles of the invention, but it is to be understood that such detailed description is not to be taken in a limiting sense.

BRIEF DESCRIPTION OF THE DRAWINGS

Figure 1:
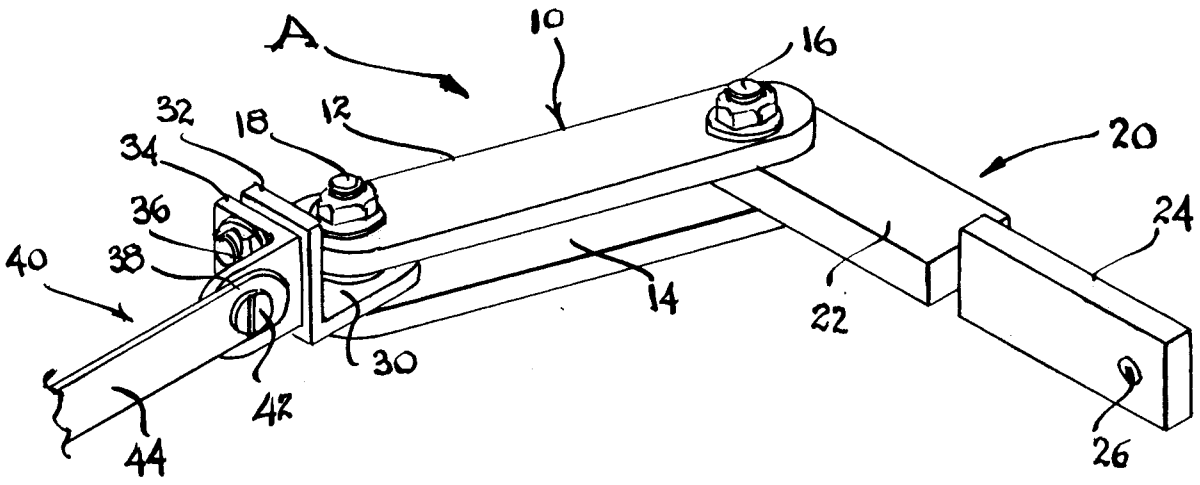
Figure 2:
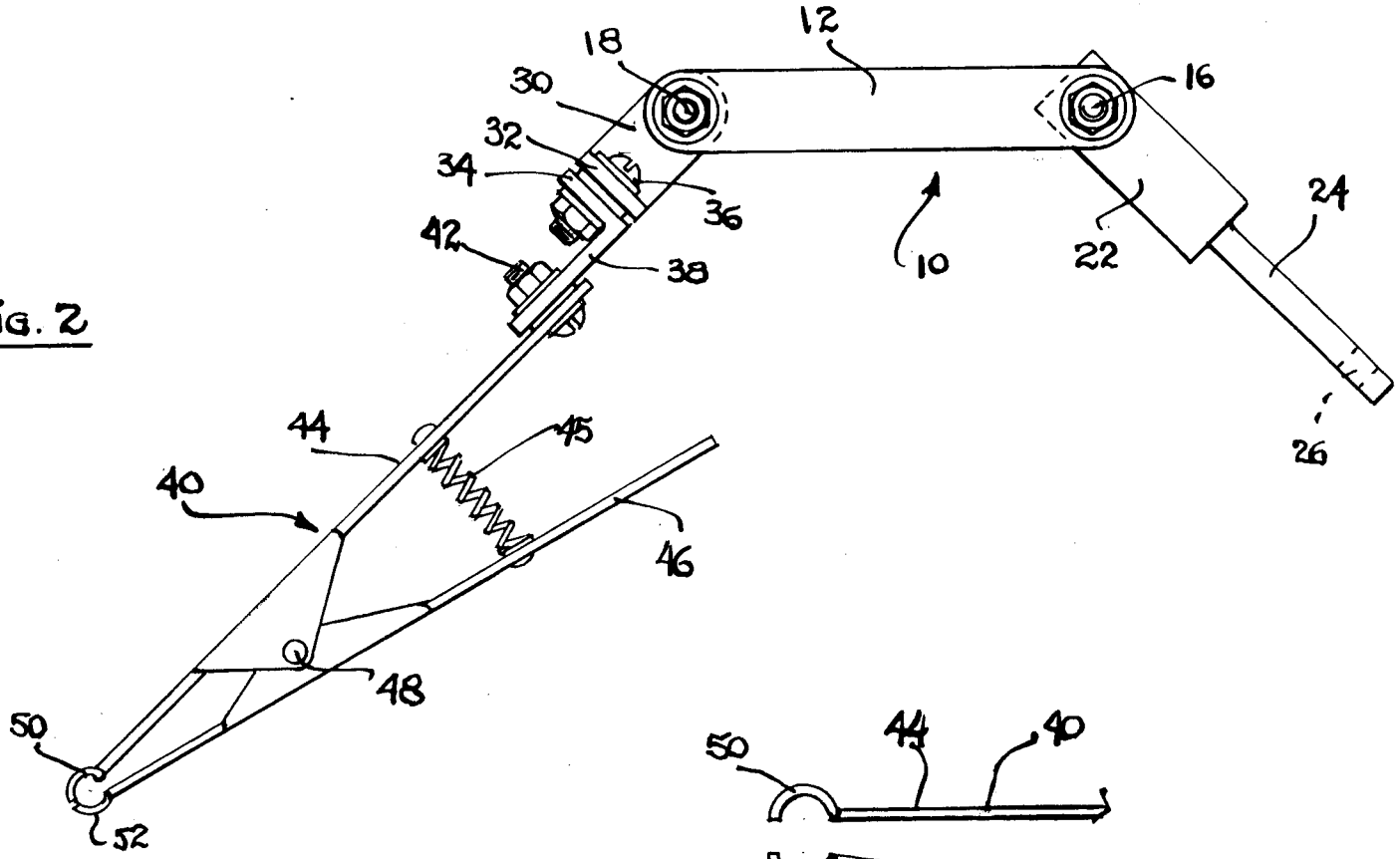
Figure 3:
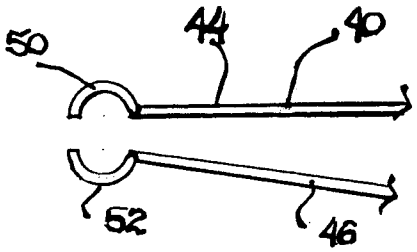
Figure 4:
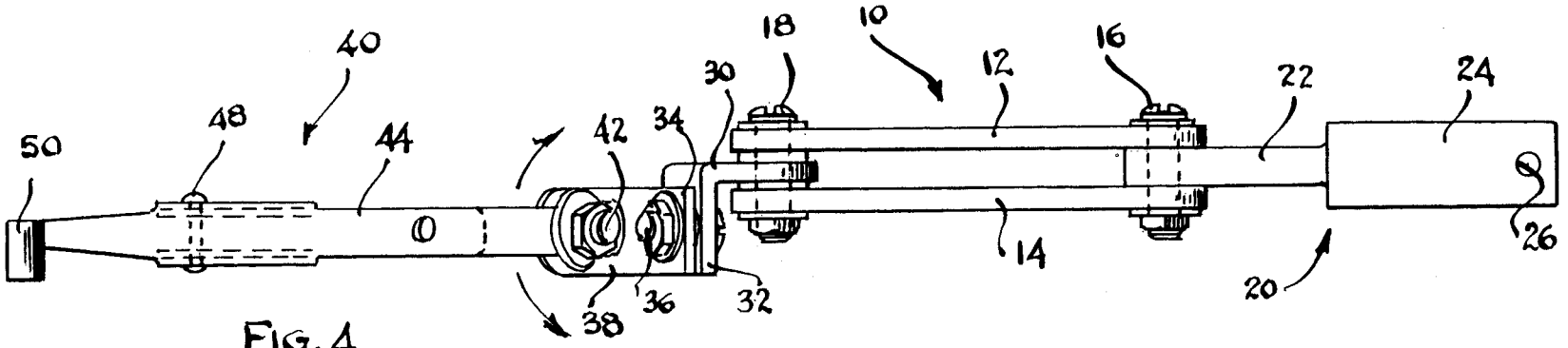

Having thus described the invention in general terms, reference will now be made to the accompanying drawings (three sheets) in which:

FIG. 1 is a perspective view of a work positioning device constructed in accordance with and embodying the present invention;

FIG. 2 is a top plan view of the work positioning device of FIG. 1;

FIG. 3 is an alternate view of a clamp forming part of the work positioning device with respect to FIG. 2;

FIG. 4 is a front elevational view of the work positioning device; and

Figure 5:
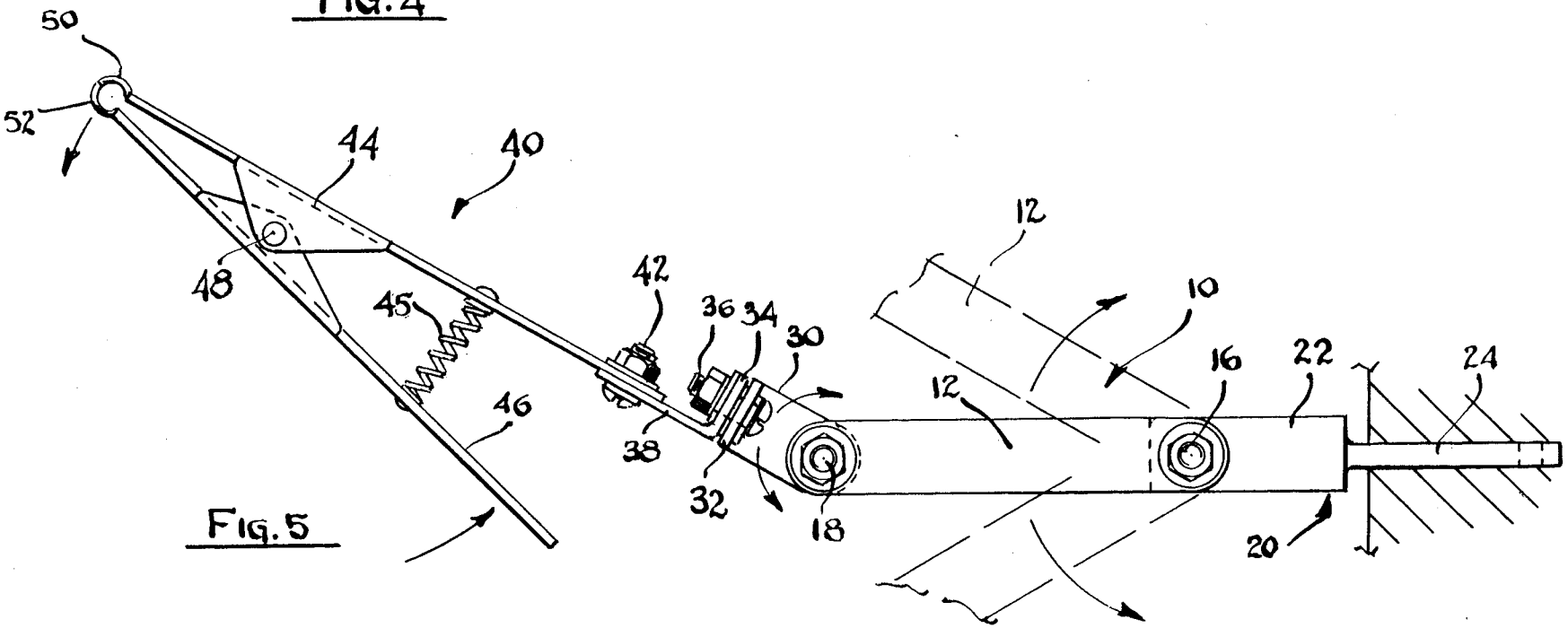

FIG. 5 is a top plan view of the work positioning device showing the positioning arms and the mounting arms in alternate positions with respect to the arrangement as shown in FIG. 2.

DETAILED DESCRIPTION OF A PREFERRED EMBODIMENT

Referring now in more detail and by reference characters to the drawings which illustrate a preferred embodiment of the present invention, A designates a work positioning device comprising a main frame 10 comprised of a pair of spaced apart generally horizontally disposed and generally parallel plates 12 and 14, as best shown in FIG. 1. The plates 12 and 14 are connected together adjacent their opposite ends by means of a pair of pins 16 and 18. The plates 12 and 14 are generally elongate and are only spaced apart from one another by a relatively short distance.

Pivotally secured to the frame 10 at one end thereof, is a mounting arm assembly 20 comprised of a first mounted arm section 22 and a second mounting arm section 24, the latter of which is perpendicularly arranged with respect to the mounting arm section 22. By further reference to FIG. 1 and by reference to FIG. 2, it can be observed that the mounting arm section 22 is generally flat and horizontally disposed so that it is parallel in space to the plates 12 and 14. The mounting arm section 22 is pivotally retained on the pin 16 in the manner as best illustrated in FIGS. 1 and 2. The mounting arm section 24 may be welded or otherwise rigidly secured to the outer end of the mounting arm section 22.

The mounting arm section 24 is also provided with an opening 26 at its outer end for securement to a fixed structure. In this way, the entire work positioning device A may be retained upon a fixed structure. Moreover, the mounting arm section 24 could be pivotally mounted to or otherwise rigidly secured to that fixed structure. Further, and if desired, the mounting arm section 22 could also be provided with an opening (not shown) in order to secure the entire work positioning device with respect to a horizontally disposed mounting arm section, to a vertically arranged mounting arm section 24.

Pivotally secured to the pivot pin 18 is a first positioning arm 30 and which is also generally horizontally disposed and parallel in space to the plates 12 and 14. The first positioning arm is provided with an angularly struck flange 32 and which is preferably perpendicularly arranged with respect to the flat horizontally disposed positioning arm 30. The work positioning device also comprises a second positioning arm 34 which is pivotally secured to the flange 32 through a pivot pin 36. Thus, and in the embodiment as illustrated, the positioning arm 34 would normally be perpendicular in space relative to the first positioning arm 34 and perpendicular in space relative to the plates 12 and 14 forming part of the frame 10. The second positioning arm is also provided with an angularly struck flange 38 and preferably a perpendicularly arranged flange. A work holding implement in the form of a clamp 40 is pivotally secured to the flange 38 through a pivot pin 42, also as best illustrated in FIGS. 1 and 2 of the drawings.

The clamp 40 is preferably in the form of a type of tweezers and comprises a pair of clamping arms 44 and 46 which are pivotally secured intermediate their ends by means of a pivot pin 48. Moreover, a spring biasing mechanism 45 is associated with the clamping arms 44 and 46 for biasing the same to the closed position, as illustrated in FIG. 2 of the drawings. The work holding clamp 40 is shown in the closed position in FIG. 2 of the drawings and in the open position in FIG. 3.

The work clamping arms 44 and 46 are provided at an outer end with arcuately shaped terminal portions 50 which thereby form a somewhat cylindrically shaped opening 52. In this way, the work holding mechanism 40 is sized and designed so as to be capable of engaging an electric conductor or like work member. Naturally, any type of clamping mechanism or other work holding member could be provided with the work positioning device.

It should be understood that all various types of work holding members could be provided, that is, different types of clamping mechanisms and different sizes of clamping mechanisms. For this purpose, the pin 42 could be a removable releasable pin so as to enable a pivotal connection of an alternate form of work holding member.

It can be seen that the pivot pin 16 constitutes a first axis of rotation and the pivot pin 18 constitutes a second axis of rotation. In this case, the two axes of rotation defined by the pivot pins 16 and 18 are parallel in space. The pivot pin 36 identifies a third axis of rotation. In this case, the third axis of rotation is perpendicular to the first two axes of rotation. Finally, the pin 42 constitutes a fourth additional axis of rotation. The pin 42 would therefore identify an axis of rotation which is parallel in space to the axis of rotation defined by the pin 36.

The above identified work positioning mechanism has been constructed and found to be highly effective in operation. It constitutes a versatile way of positioning a work piece with respect to a tool or other member. In addition, it is easy to use and simple to adjust. More importantly, it does not require time-consuming manipulation which is presently required by essentially all of the prior art work clamping mechanism.

Thus, there has been illustrated and described a unique and novel work positioning device which achieves all of the objects and advantages which have been sought therefore. It should be understood, that many changes, modifications, variations and other uses or applications will become apparent to those skilled in the art after considering this specification and the accompanying drawings. Therefore, any and all such changes, modifications, variations, and other uses and applications which do not depart from the spirit and scope of the invention are deemed to be covered by the invention.

Having thus described the invention, what I desire to claim and secure by letters patent is:

1. A work positioning device for positioning a work piece with respect to a tool in an essentially unlimited number of positions, said work positioning device comprising:

(a) a frame;

(b) a mounting arm pivotally connected to one end of said frame enabling said frame to be rotatable about a first axis, said mounting arm being adapted for securement to a fixed structure;

(c) a first positioning arm pivotally connected to another end of said frame and being rotatable about a second axis with respect to said frame, said second axis being generally parallel in space to said first axis so that the first positioning arm moves in a plane generally parallel to said mounting arm;

(d) a second positioning arm pivotally connected to said first positioning arm and being rotatable about a third axis which is generally perpendicular in space to said second axis;

(e) a work holding arm pivotally connected to said second positioning arm and being rotatable with respect thereto about a fourth axis, said work holding arm being capable of being moved to an essentially unlimited number of positions through said four axes with respect to a tool;

(f) means associated with said mounting arm to permit said mounting arm to be pivotally connected to a fixed structure about a fifth axis; and (g) means associated with said work holding arm to releasably secure a work piece thereto.

2. The work positioning device of claim 1 further characterized in that said second axis is generally parallel in space to said first axis so that said first positioning arm moves in a plane generally parallel to said mounting arm.

3. The work positioning device of claim 1 further characterized in that said third axis is generally perpendicular to said second axis.

4. The work positioning device of claim 3 further characterized in that said first positioning arm has an angularly struck portion and said second positioning arm is pivotally secured to said angularly struck portion.

5. The work positioning device of claim 4 further characterized in that said second positioning arm has an angularly struck portion and said angularly struck portion of said first positioning arm is pivotally secured to the angularly struck portion of said second positioning arm.

6. The work positioning device of claim 1 further characterized in that said mounting arm has an angularly offset portion for mounting to a fixed structure.

7. The work positioning device of claim 5 further characterized in that said fourth axis of rotation is generally perpendicular to said third axis of rotation.

8. A work positioning device for positioning a work piece relative to a tool in an essentially unlimited number of positions, said work positioning device comprising:

(a) a frame;

(b) a mounting arm pivotally connected to one end of said frame enabling said frame to be rotatable about a first axis, said mounting arm being adapted fro securement to a fixed structure;

(c) a first positioning arm pivotally connected to another end of said frame and being rotatable about a second axis with respect to said frame, and which is generally parallel in space to said first axis so that said first positioning arm moves in a plane generally parrallel to the plane of movement of the mounting arm;

(d) a second positioning arm pivotally connected to an end of said first positioning arm and being rotatable about a third axis which is generally perpendicular in space to the first axis and to the second axis; (e) a work holding arm operatively pivotally connected to said second positioning arm and being rotatable with respect thereto about a fourth axis which is generally perpendicular to the axis of rotation of said third axis, said work holding arm being capable of being moved to an essentially unlimited number of positions through said axes with respect to a tool; and (f) means associated with said work holding arm to releasably secure a work piece thereto.

9. The work positioning device of claim 8 further characterized in that said first positioning arm has an angularly struck portion and said second positioning arm is pivotally secured to said angularly struck portion.

10. The work positioning device of claim 9 further characterized in that said second positioning arm has an angularly struck portion and said angularly struck portion of said first positioning arm is pivotally secured to the angularly struck portion of said second positioning arm.

11. The work positioning device of claim 8 further characterized in that said mounting arm has an angularly offset portion for mounting to a fixed structure.

12. A work positioning device for positioning a work piece with respect to a tool in an essentially unlimited number of positions, said work positioning device comprising:

(a) a frame;

(b) a mounting arm pivotally connected to one end of said frame enabling said frame to be rotatable about a first axis, said mounting arm being adapted for securement to a fixed structure;

(c) a first positioning arm having one end pivotally connected to another end of said frame and being rotatable about a second axis with respect to said frame;

(d) an angularly struck portion on the end of said first positioning arm and extending outwardly beyond the plane of the first positioning arm;

(e) a second positioning arm;

(f) an angularly struck portion on an end of the second positioning arm pivotally connected to the angularly struck portion on said first positioning arm and being rotatable about a third axis;

(g) a work holding arm pivotally connected to said second positioning arm and being rotatable with respect thereto about a fourth axis, said work holding arm being capable of being moved to an essentially unlimited number of positions through said four axes with respect to a tool; and (h) means associated with said work holding arm to releasably secure a work piece thereto.

13. The work positioning device of claim 12 further characterized in that said second axis is generally parallel in space to said first axis so that said first positioning arm moves in a plane generally parallel to said mounting arm.

14. The work positioning device of claim 13 further characterized in that said third axis is generally perpendicular to said second axis.

15. The work positioning device of claim 14 further characterized in that said mounting arm has an angularly offset portion for mounting to a fixed structure.

* * * * *